US007463846B2

(12) United States Patent
Nishimura

(10) Patent No.: US 7,463,846 B2
(45) Date of Patent: Dec. 9, 2008

(54) PHOTOSENSITIVE DRUM

(75) Inventor: Ryoji Nishimura, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 314 days.

(21) Appl. No.: 11/338,348

(22) Filed: Jan. 24, 2006

(65) Prior Publication Data

US 2006/0165436 A1 Jul. 27, 2006

(30) Foreign Application Priority Data

Jan. 25, 2005 (JP) ..... 2005-016725

(51) Int. Cl.
*G03G 15/00* (2006.01)

(52) U.S. Cl. ..... 399/117; 399/159

(58) Field of Classification Search ..... 399/116, 399/117, 159
See application file for complete search history.

(56) References Cited

U.S. PATENT DOCUMENTS 5,953,562 A * 9/1999 Kawaguchi et al. ..... 399/117
6,029,019 A * 2/2000 Kawai ..... 399/117 X
6,175,705 B1 * 1/2001 Harada et al. ..... 399/117
6,704,540 B2 3/2004 Maeshima et al.

FOREIGN PATENT DOCUMENTS

JP 200214514 1/2002
JP 2002137489 5/2002

OTHER PUBLICATIONS

Chinese Office Action.

* cited by examiner

*Primary Examiner*—David M Gray
*Assistant Examiner*—Erika J. Villaluna
(74) *Attorney, Agent, or Firm*—The Webb Law Firm

(57) ABSTRACT

To realize easier assembly of the photosensitive drum with appropriate contact force to the end face of the drum body, while restricting manufacture cost increase and avoiding need for high skill and/or experience for the factory worker who assembles the drum. A photosensitive drum for use in an electrophotographic image forming apparatus. The drum includes a cylindrical drum body 11 having a photosensitive layer, a pair of flanges 12*a*, 12*b* attached to opposed end faces of the drum body, a reinforcing stay 13 provided inside the drum body, a drum shaft 14 for rotatably supporting the drum body via the flanges. The flanges are fixed to the reinforcing stay in such a manner that outer peripheries of the flanges are elastically contacted against the end faces of the drum body. Each flange includes, as a cantilever-like extension thereof, a fixing arm 18 for the reinforcing stay, a leading end of the fixing arm being fixed to the reinforcing stay with the fixing arm being elastically deformed toward the inside of the drum body, such that the fixing arm provides an elastic resilience for causing the outer periphery of the flange to be elastically contacted against the corresponding end face of the drum body.

3 Claims, 7 Drawing Sheets

--PRIOR ART--

PHOTOSENSITIVE DRUM

BACKGROUND OF THE INVENTION

1. Field of the Invention

The present invention relates to a photosensitive drum for use in an electrophotographic image forming apparatus. The drum includes a cylindrical drum body having a photosensitive layer, a pair of flanges attached to opposed end faces of the drum body, a reinforcing stay provided inside the drum body and a drum shaft for rotatably supporting the drum body via the flange. The flanges are fixed to the reinforcing stay in such a manner that outer peripheries of the flanges are elastically contacted against the end faces of the drum body 2. Related Art With the photosensitive drum of the above-noted type, when the pair of flanges are attached to the opposed end faces of the drum body, in order to restrict deformation in the drum body when the flanges are attached thereto and relative displacement between the axis of the drum body and the axis of the drum shaft, due to e.g. tolerances in the manufactures of the drum body, the flanges, the reinforcing stays, the flanges are fixed to the reinforcing stay in such a manner that the outer peripheries of the flanges are elastically contacted against the end faces of the drum body.

In the case of a conventional photosensitive drum illustrated in FIG. 9, a pair of bar-like support members 40 are provided integrally with a reinforcing stay 13. Each flange 12 defines through holes 41 for allowing insertion of respective ends of the bar-like support members 40. A screw 35 is threaded, from the outer side of the flange 12, on the end of the bar-like support member 40 inserted in the insertion hole 41 of each flange 12. Further, a compression spring 42 is mounted between the head of the screw 35 and the outer face of the flange 12 so as to provide an urging force for causing the outer periphery of the flange 12 to be elastically contacted against the end face of a drum body 11, whereby the flange 12 is fixed to a reinforcing stay 13.

In the photosensitive drum having the above-described construction, in causing the outer periphery of the flange to be elastically contacted against the end face of a drum body, the contact force, if excessive, will tend to invite deformation in the drum body, whereas the contact force, if insufficient, will tend to invite free rotational displacement of the flange relative to the drum body. Furthermore, non-uniformity in the contact force in the peripheral direction of the drum will tend to invite a twisting distortion in the drum body. All of these conditions tend to lead to disturbance in the formed image. For this reason, the elastic contact needs to provided so as to realize substantially uniform distribution of the appropriate amount of contact force along the peripheral direction of the drum.

However, according to the above-described conventional art, the urging force from the compression spring 42, that is, the magnitude of the contact force to be applied from the flange 12 against the drum body 11, is set by way of an amount or depth of the threading engagement of the screw 35 relative to the bar-like support member 40. Hence, in order to elastically contact the outer periphery of each flange 12 against the end face of the drum body 11 so as to realize such substantially uniform distribution of appropriate contact force along the peripheral direction of the drum, precision management of the threading depth of the screw 35 is needed and such precision management requires skill and good experience for the assembling factory worker and this also intends to invite disadvantageous increase in the manufacture cost of the drum.

The present invention has been made in view of the above-described state of the art. A primary object of this invention is to realize easier assembly of the photosensitive drum with appropriate contact force to the end face of the drum body, while restricting manufacture cost increase and avoiding need for high skill and/or experience for the factory worker who assembles the drum.

SUMMARY OF THE INVENTION

For accomplishing the above-noted object, according to the first characterizing feature of the present invention, there is proposed a photosensitive drum for use in an electrophotographic image forming apparatus, the drum comprising:

a cylindrical drum body having a photosensitive layer;

a pair of flanges attached to opposed end faces of the drum body;

a reinforcing stay provided inside the drum body;

a drum shaft for rotatably supporting the drum body via the flanges;

said flanges being fixed to the reinforcing stay in such a manner that outer peripheries of the flanges are elastically contacted against the end faces of the drum body;

wherein said each flange includes, as a cantilever-like extension thereof, a fixing arm for the reinforcing stay, a leading end of the fixing arm being fixed to the reinforcing stay with the fixing arm being elastically deformed toward the inside of the drum body, such that the fixing arm provides an elastic resilience for causing the outer periphery of the flange to be elastically contacted against the corresponding end face of the drum body.

With the above-described construction of the present invention, in elastically contacting the outer periphery of the flange against the end face of the drum body, unlike the conventional technique which depends on the threading depth of the screw for setting of the amount of the contact force applied from the flange to the drum body, the fixing arm for the reinforcing stay is provided as a cantilever-like extension of the flange. Then, the leading end of this fixing arm is fixed to the reinforcing stay with the fixing arm being elastically deformed toward the inside of the drum body, such that the fixing arm provides an elastic resilience for causing the outer periphery of the flange to be elastically contacted against the corresponding end face of the drum body. So, this elastic resilience of the fixing arm can be set as the contact force to be applied from the flange to the drum body.

Therefore, by simply fixing the leading end of the fixing arm to the reinforcing stay, a substantially constant contact force can be set. As a result, it has become possible to allow easier assembly of the photosensitive drum with appropriate contact force to the end face of the drum body, while restricting manufacture cost increase and avoiding need for high skill or experience for the factory worker who assembles the drum.

According to the second characterizing feature of the present invention, the flange includes a reinforcing rib which projects toward the inside of the drum body and which extends in the form of a ring about said drum shaft, said fixing arm being supported in the cantilever manner to a projecting end of said reinforcing rib.

With the above construction, in order to effectively restrict deformation of the flange, the flange includes the reinforcing rib which projects toward the inside of the drum body and which extends in the form of a ring about the drum shaft. And, the fixing arm is supported in the cantilever manner to a projecting end of the reinforcing rib. Hence, the elastic resilience of the fixing arm can be transmitted efficiently via the flange with its deformation being effectively restricted by the reinforcing rib, as the contact force to be applied from the flange to the drum body.

According to the third characterizing feature of the present invention, said each flange defines a slit extending in the form of an angular hook shape surrounding an outer periphery of said fixing arm, thereby forming the fixing arm in the form of a cantilever formed integral with the flange; and opposed ends of said hook-shaped slit extend beyond a fixing element attaching portion of the fixing arm toward a base end of the fixing arm.

As each flange defines a slit extending in the form of an angular hook shape surrounding an outer periphery of said fixing arm, thereby forming the fixing arm in the form of a cantilever formed integral with the flange, the number of members used to form the drum can be reduced advantageously, thus further restricting the manufacture cost.

Moreover, since opposed ends of the hook-shaped slit extend beyond a fixing element attaching portion of the fixing arm toward a base end of the fixing arm, it is easier to secure a greater amount of elastic deformation for the fixing arm, so that a desired amount of contact force can be easily set.

Further and other features and advantages of the present invention will become apparent upon reading the following detailed description of the preferred embodiments thereof with reference to the accompanying drawings.

DESCRIPTION OF PREFERRED EMBODIMENTS

Figure 1:
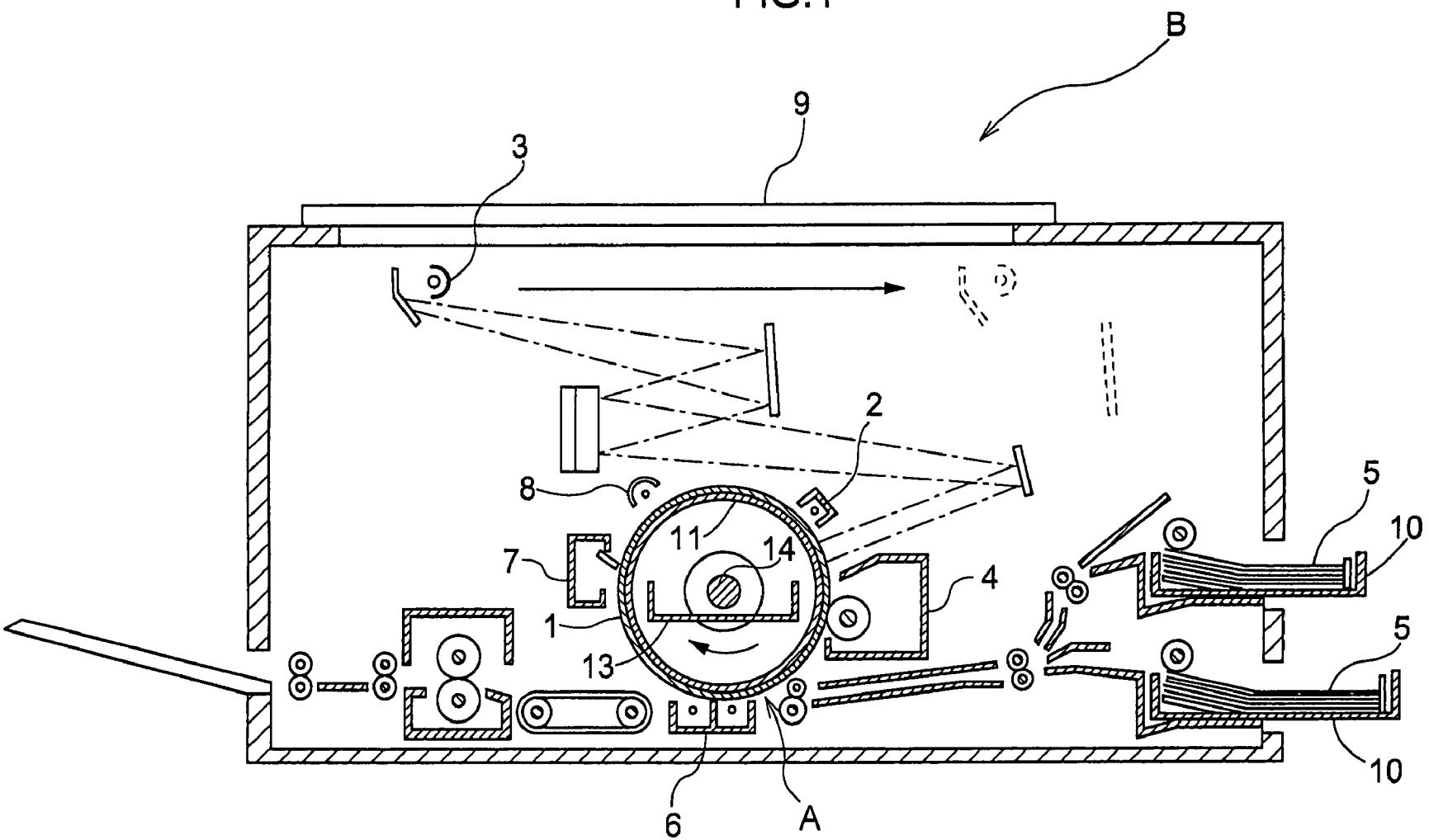
FIG. 1 is a schematic view showing an electrophotographic image forming apparatus.

Preferred embodiments of the present invention will be described in details with reference to the accompanying drawings. In these drawings, those portions same as the conventional art will be denoted with same reference numerals.

First Embodiment

FIG. 1 shows a schematic construction of an electrophotographic copier B as an example of an electrophotographic image forming apparatus. As shown, around a photosensitive drum A disposed at the center of the apparatus and constructed according to the present invention, there are provided a charger unit 2 for charging a photosensitive layer 1 of the photosensitive drum A, an exposure unit 3 for forming an electrostatic latent image on the photosensitive layer 1, a developing unit 4 for developing the electrostatic latent image with toner into a toner image, a transfer/separator unit for transferring the toner image onto a recording paper 5, a cleaner unit 7 for removing any toner remaining on the photosensitive layer 1, and an electricity removing unit 8 for removing any electric charge remaining on the photosensitive layer 1, in the mentioned order. Further, a document table 9 for receiving an original document thereon is mounted on the upper face of the apparatus body and a paper feeding tray 10 is attached to a lateral side of the apparatus body.

Figure 2:
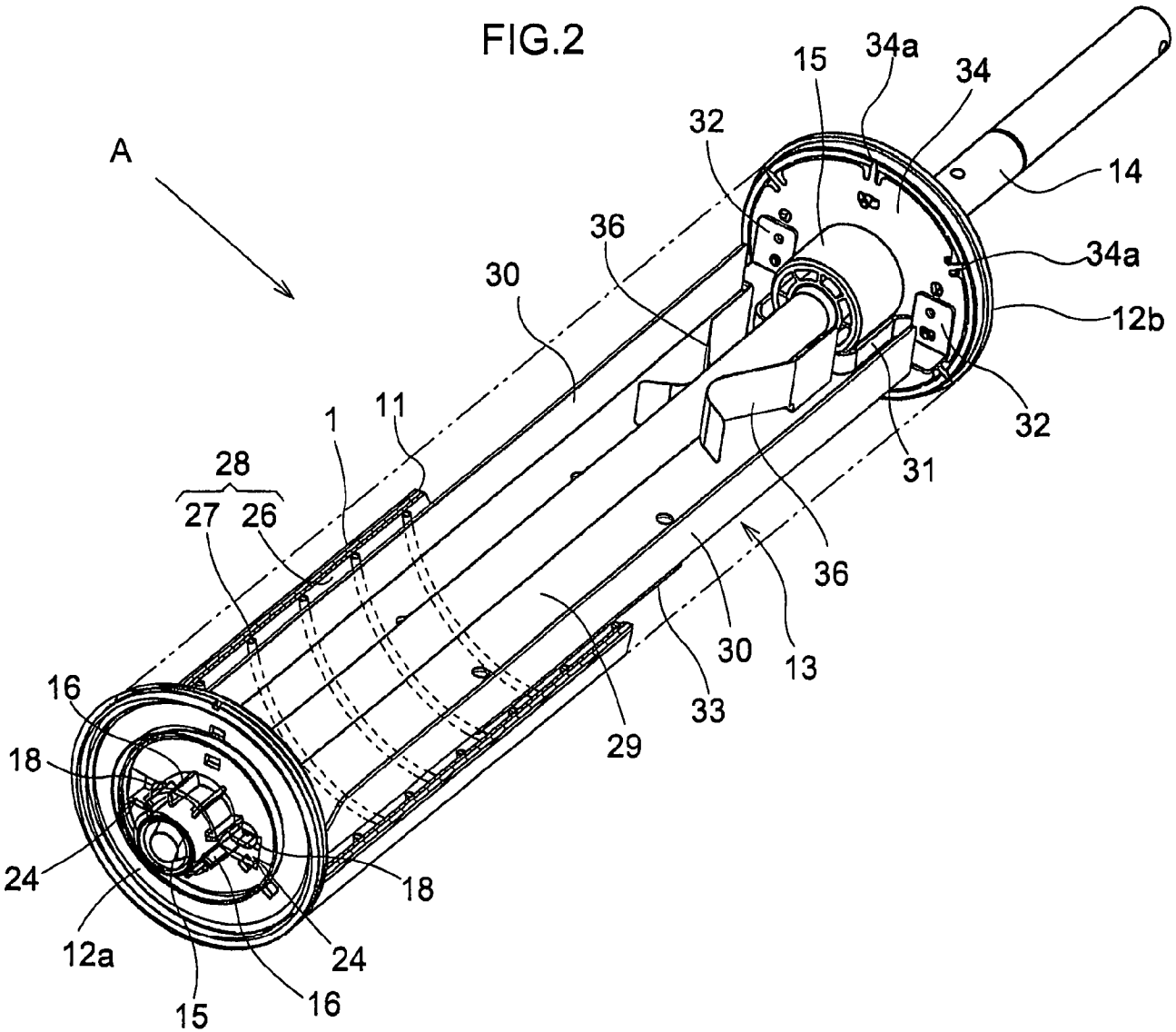
FIG. 2 is a perspective view of a photosensitive drum as seen from an upper side of a reinforcing stay.
Figure 3:
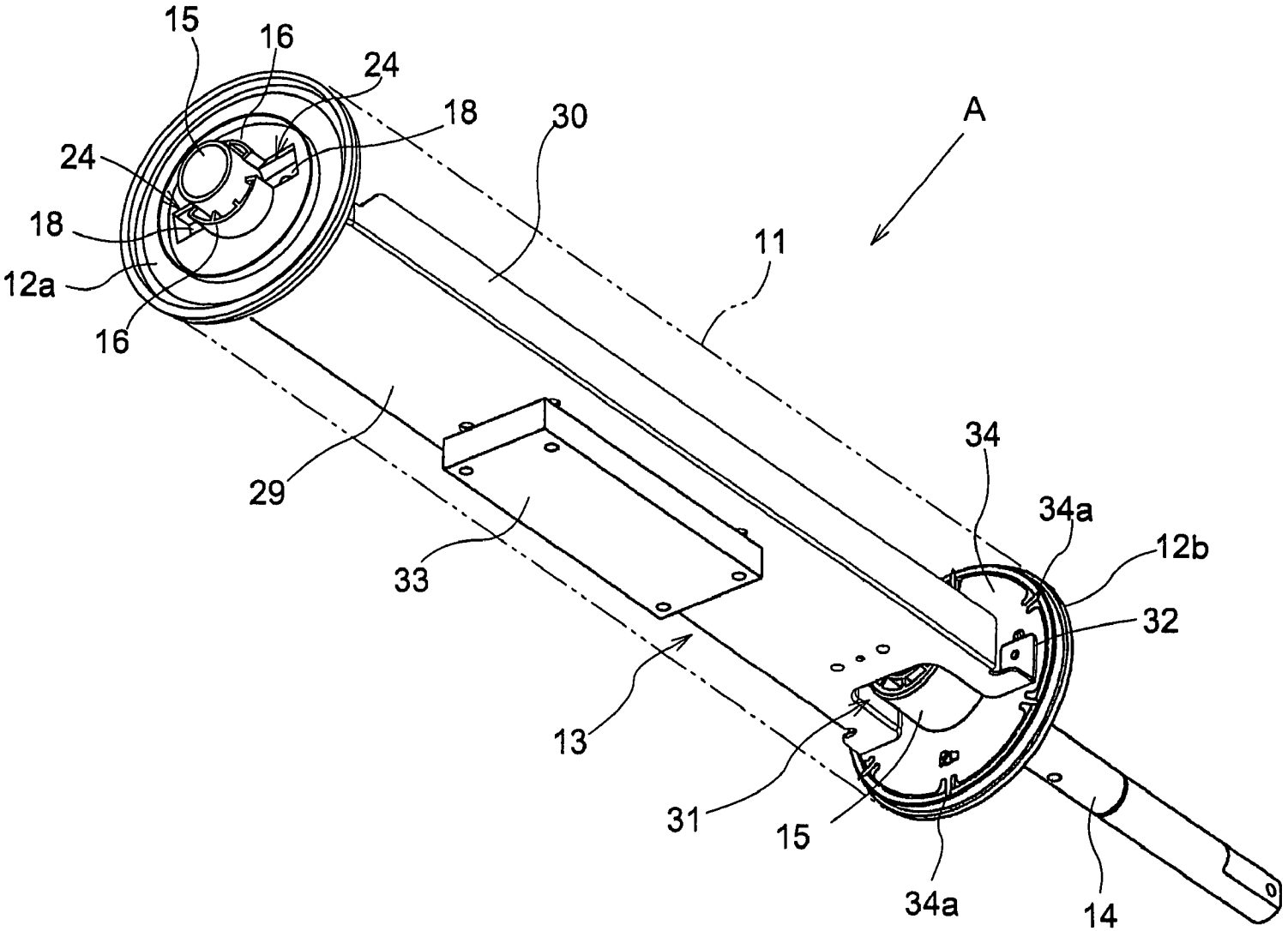
FIG. 3 is a perspective view of the photosensitive drum as seen from a lower side of a reinforcing stay.

Referring now to FIGS. 2 and 3, the photosensitive drum A includes a cylindrical drum body 11 having the photosensitive layer 1 on its outer surface, a pair of disc-like flanges 12*a*, 12*b* attached to opposed end faces of the drum body 11, a reinforcing stay 13 provided inside the drum body 11 and made of a conductive material such as a metal, and a drum shaft 14 for rotatably supporting the drum body 11 about a predetermined axis via the flanges 12*a*, 12*b*. Each flange 12*a*, 12*b* is fixed to the reinforcing stay 13 in such a manner that an outer periphery thereof may be elastically contacted against the corresponding end face of the drum body 11. The drum body 11 is made of a conductive base plate and the photosensitive layer 1 comprises a lamination of amorphous silicon photoconductor.

Figure 4:
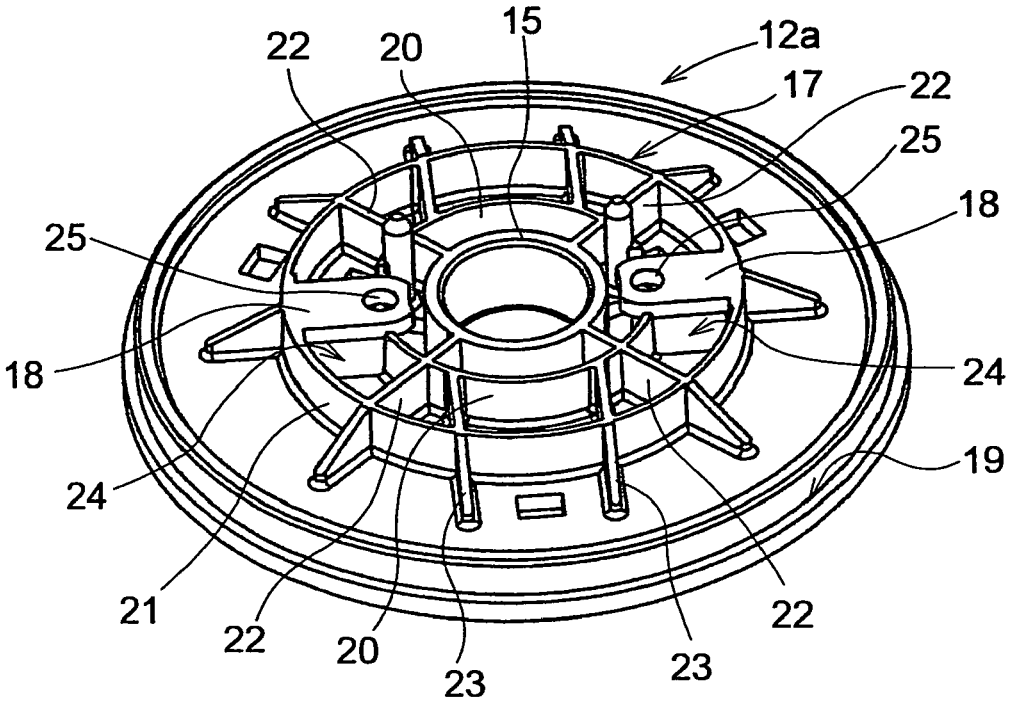
FIG. 4 is a perspective view of a flange.
Figure 5:
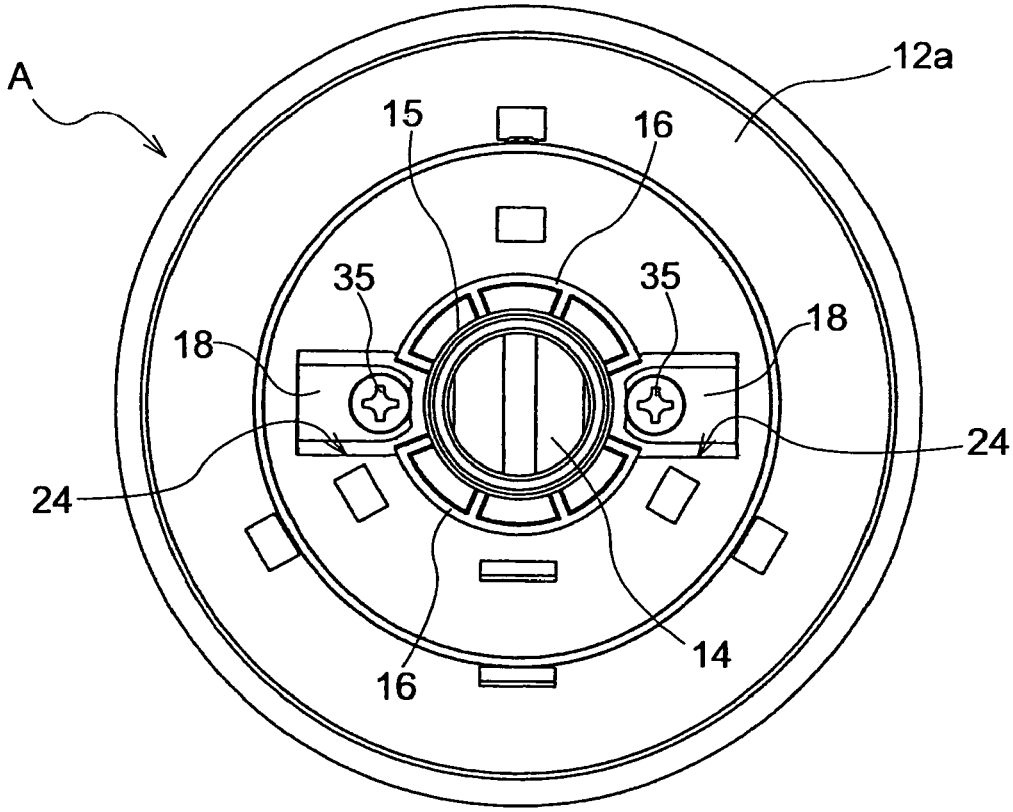
FIG. 5 is an end view of the photosensitive drum.

The flange 12*a*, 12*b* is made of a resin such as polycarbonate resin. As shown in FIG. 4 and FIG. 5, the front-end flange 12*a* integrally forms a shaft receiving boss 15 for receiving the drum shaft 14 therein, an outer rib structure 16 for reinforcing the shaft receiving boss 15 on the outer peripheral side of the flange 12*a*, an inner rib structure 17 for reinforcing the inner side of the front-end flange 12*a* together with the shaft receiving boss 15, a pair of band-like fixing arms 18 for fixation to the reinforcing stay 13, and an abutment face 19 formed on an inner face of the outer periphery of the flange 12*a* for its abutment to the end face of the drum body 11.

Referring to the details of the inner rib structure 17, a pair of arcuate reinforcing ribs 20 disposed in radial opposition to and left-right symmetry relative to the shaft receiving boss 15. Further, around these paired arcuate reinforcing ribs 20 and concentric about the drum shaft 14, there is provided a circular reinforcing rib 21. There are disposed in radial distribution, a plurality of first connecting ribs 22 connecting the shaft receiving boss 15, the arcuate reinforcing ribs 20 and the circular reinforcing rib 21. Further, for connection between the arcuate reinforcing ribs 20 and the circular reinforcing rib 21, there are disposed second connecting ribs 23 substantially parallel with each other. These ribs together constituting the inner rib structure 17 are formed integrally with each other so as to project toward the inner side of the drum body 11 by a substantially same projection amount as the shaft receiving boss 15.

The fixing arms 18 are formed as integral cantilever-like extensions of the flange. More particularly, flange portions between the pair of arcuate reinforcing ribs 20 are punched out to form through holes 24, thereby to form the cantilever-like fixing arms 18 disposed between the projecting ends of the circular reinforcing rib 21 to project between the paired arcuate reinforcing ribs 20 and projecting toward the shaft receiving boss 15 from the opposite sides thereof. Each fixing arm 18 defines a fixing screw hole 25 adjacent its leading end.

The front-end flange 12*a* has been described above as an example. The rear-end flange 12*b* has an identical construction to the front-end flange 12*a*.

Referring back to FIG. 2, along the inner peripheral face of the drum body 11, there is provided a drum heater 28 including a heat conducting plate 26 provided as a parallelogram plate member made of stainless steel and a heating wire 27 affixed in a meandering manner to the heat conducting plate 26. The heat conducting plate 26 includes a thermistor (not shown) placed in contact with the heating wire 27 for detecting temperature of this wire 27 per se.

Figure 6:
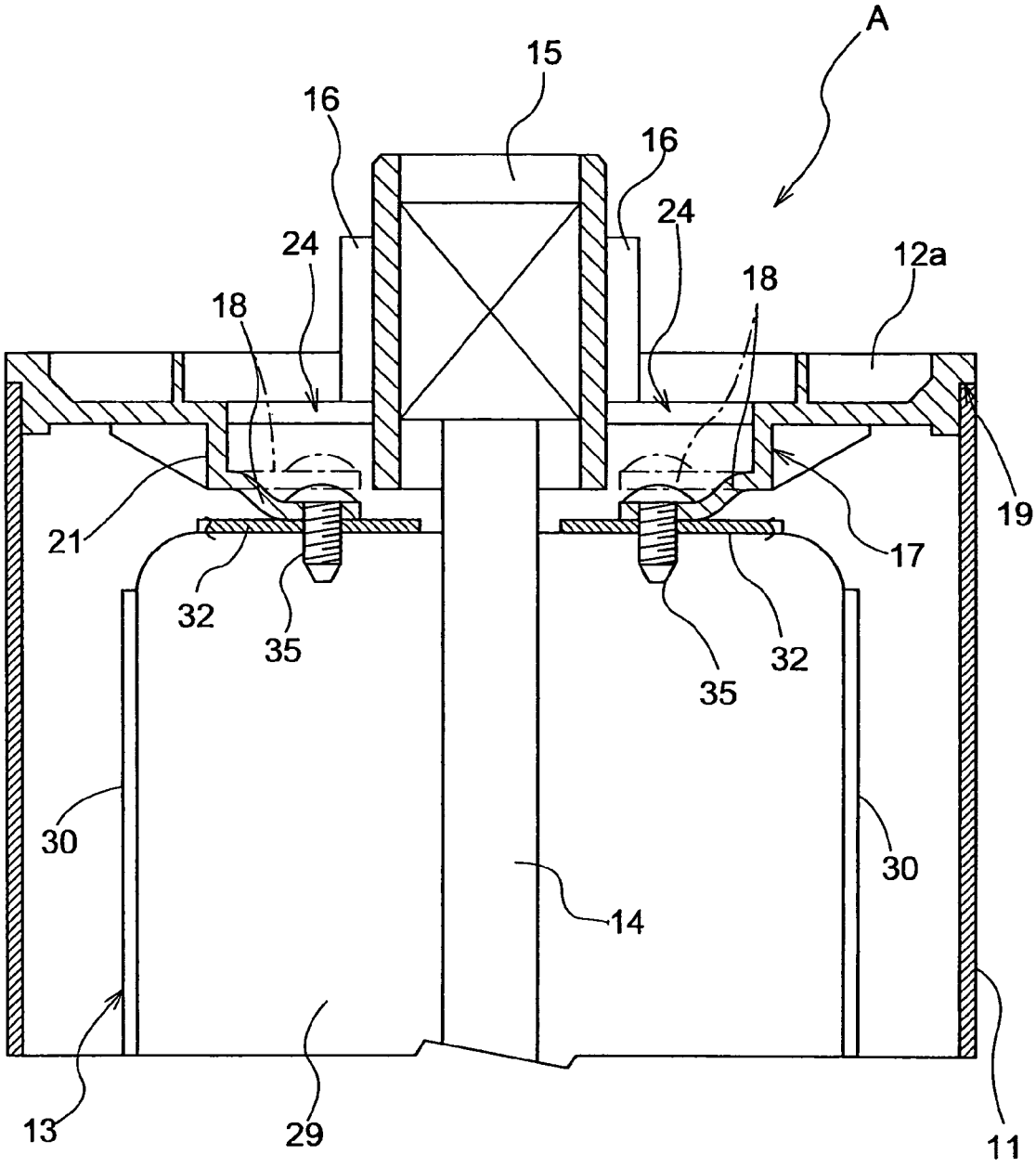
FIG. 6 is a vertical section showing principal portions of the photosensitive drum.

As shown in FIG. 2, FIG. 3 and FIG. 6, the reinforcing stay 13 includes a stay base 29 extending axially and a pair of reinforcing flanges 30 formed by bending width-wise opposed ends of the base 29. Further, axial opposed ends of the reinforcing stay 13 relative to the drum axis are also bent in a direction normal to the drum shaft 14 to extend along the inner face of each flange 12*a*, 12*b*, thereby forming a pair of right and left fixing portions 32 for each flange 12*a*, 12*b*. Adjacent its axial end adjacent the rear-end flange 12*b*, the stay 13 defines a recess 31 for receiving therein the shaft receiving boss 15 of the rear-end flange 12*b* and on the back face of the reinforcing stay 13, there is affixed a temperature control board 33 for the drum heater 28.

For attachment of each flange 12*a*, 12*b* to the corresponding end face of the drum body 11, as illustrated in FIG. 5 and FIG. 6, the abutment face 19 will be brought into abutment against the end face of the drum body 11 thereby to elastically deform the fixing arm 18 toward the inner side of the drum body 11. Under this elastically deformed condition, the leading end of the fixing arm 18 is fastened to the fixing portion 32 by means of a screw 35. With this, the fixing arm 18 provides an elastic resilience to cause the outer periphery of the flange 12*a*, 12*b* to be elastically contacted against the end face of the drum 11. Upon such attachment of the two flanges 12*a*, 12*b*, the pair of flanges 12*a*, 12*b* elastically bind the drum body 11 therebetween, whereby the assembly of the photosensitive drum A is completed.

Incidentally, as shown in FIG. 2 and FIG. 3, the fixing arm 18 of the rear-end flange 12*b* is fastened, via a drum grounding (electrical ) plate 34, to the fixing portion 32 by the screw 35.

Also, although FIG. 6 shows the fixing construction of the front-end flange 12*a* to the reinforcing stay 13 as an example, the fixing construction of the rear-end flange 12*b* is substantially the same. And, in this figure, the elastically deformed condition of the fixing arm 18 is shown in exaggeration for easier visual understanding.

More particularly, a distance between the opposed abutment faces 19 of the flanges 12*a*, 12*b* is sized in advance to be shorter than the distance between the opposed end faces of the drum body 11 if the ending ends of the fixing arms 18 of the respective flanges 12*a*, 12*b* are fastened to the reinforcing stay 13 by the screws 35 without placing the abutment faces 19 of the flanges 12*a*, 12*b* into abutment against the end faces of the drum body 11.

Referring again to the assembling operation, with keeping the abutment face 19 of each flange 12*a*, 12*b* in abutment against the corresponding end face of the drum body 11, the screw 35 inserted into the screw hole 25 of the fixing arm 18 will be progressively fastened to the reinforcing stay 13. In the course of this, the fixing arm 18 begins to be elastically deformed toward the inner side of the drum body 11. Upon completion of this fastening operation of the fixing arm 18 with the screw head and the reinforcing stay 13, the fixing arm 18 has been elastically deformed by a substantially fixed amount, so that the fixing arm 18 provides a predetermined amount of elastic resilience corresponding to this elastic deformation amount.

Also, as shown in FIGS. 2 and 3, the drum grounding plate 34 will have its grounding projection 34*a* formed on its outer periphery placed in contact with the drum body 11 and the drum grounding plate 34 main will be placed into contact with the reinforcing stay 13. And, as shown in FIG. 2, a pair of spring-like grounding elements 36 fixed to the reinforcing stay 13 will be placed across the drum shaft 14 from the opposite sides thereof thereby to ensure electric grounding between the drum body 11 and the drum shaft 14.

Second Embodiment

Figure 7:
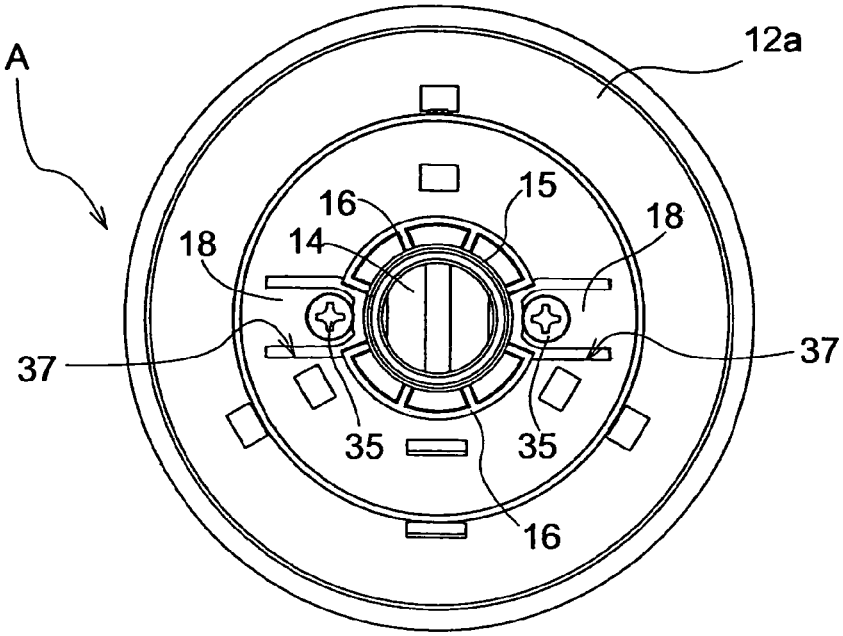
FIG. 7 is an end view of a photosensitive drum relating to a second embodiment of the invention.
Figure 8:
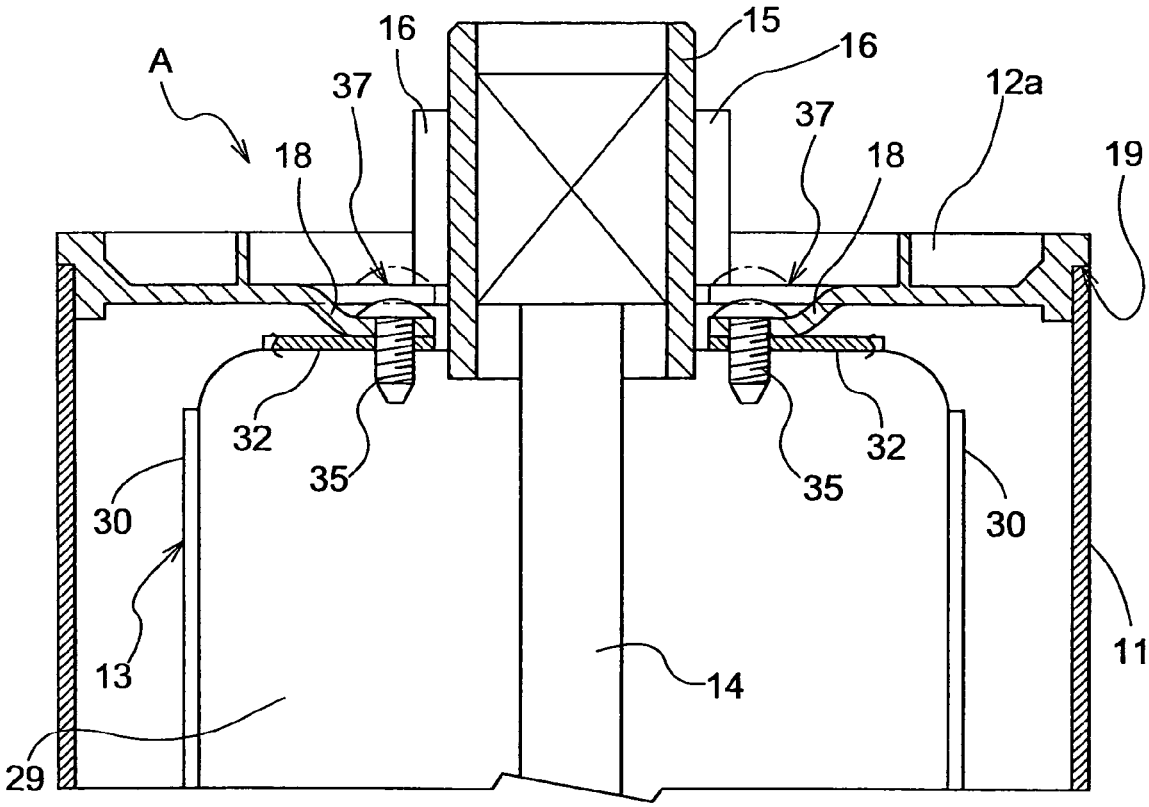
FIG. 8 is a vertical section showing principal portions of the photosensitive drum relating to the second embodiment of the invention.
Figure 9:
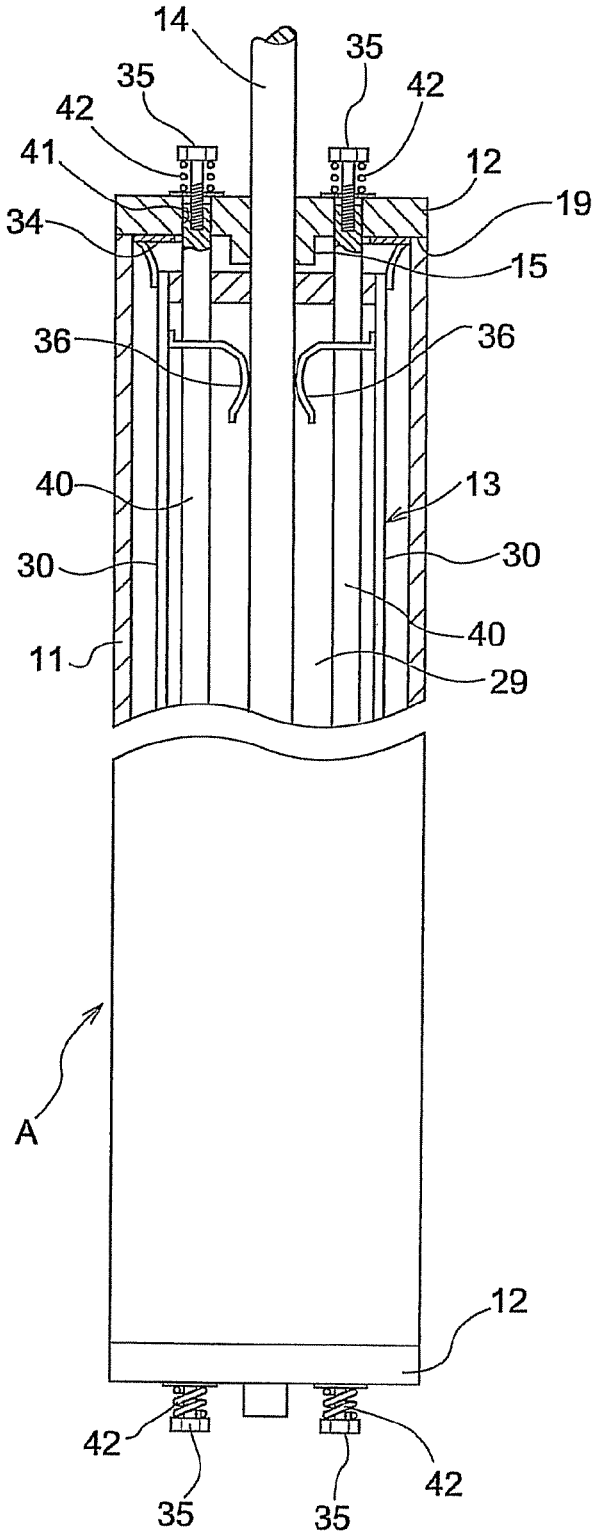
FIG. 9 is an explanatory view of a photosensitive drum according to a conventional art.

FIGS. 7 and 8 show a photosensitive drum A according to a further embodiment of the invention. In this embodiment, instead of the pair of respective flanges 12*a*, 12*b* disclosed in the first embodiment, a pair of substantially angular hooked-shaped slits 37 are defined in each flange 12*a*, 12*b*, and outer peripheries of a pair of fixing arms 18 supported like cantilevers are surrounded by the slits 37. By using these flanges 12*a*, 12*b*, the outer peripheries thereof are elastically contacted against the end face of the drum body 11.

Incidentally, although FIG. 8 illustrates the fixing construction of the front-end flange 12*a* to the reinforcing stay 13 as an example, the fixing construction of the rear-end flange 12*b* is substantially the same.

The rest of the construction is substantially the same as the first embodiment.

OTHER EMBODIMENT

1. In the photosensitive drum relating to the present invention, a fixing arm provided separately from a flange can be fixed in the cantilever manner to the flange.

2. The photosensitive drum relating to the present invention can include three or more fixing arms supported in the cantilever manner to the flange and the leading end of each fixing arm can be fixed to the reinforcing stay.

3. The photosensitive drum relating to the present invention can be used not only in a copier, a printer or the like as an electrophotographic image forming apparatus, but also in a facsimile machine.

The invention claimed is:

1. A photosensitive drum for use in an electrophotographic image forming apparatus, the drum comprising:

a cylindrical drum body having a photosensitive layer;

a pair of flanges attached to opposed end faces of the drum body;

a reinforcing stay provided inside the drum body;

a drum shaft for rotatably supporting the drum body via the flanges;

said flanges being fixed to the reinforcing stay in such a manner that outer peripheries of the flanges are elastically contacted against the end faces of the drum body;

wherein said each flange includes a fixing arm for the reinforcing stay, a leading end of the fixing arm being fixed to the reinforcing stay with the fixing arm being elastically deformed toward the inside of the drum body, such that the fixing arm provides an elastic resilience for causing the outer periphery of the flange to be elastically contacted against the corresponding end face of the drum body.

2. The photosensitive drum according to claim 1, wherein said flange includes a reinforcing rib which projects toward the inside of the drum body and which extends in the form of a ring about said drum shaft;

said fixing arm being supported in the cantilever manner to a projecting end of said reinforcing rib.

3. The photosensitive drum according to claim 1, wherein said each flange defines a slit extending in the form of an angular hook shape surrounding an outer periphery of said fixing arm, thereby forming the fixing arm in the form of a cantilever formed integral with the flange; and opposed ends of said hook-shaped slit extend beyond a fixing element attaching portion of the fixing arm toward a base end of the fixing arm.

* * * * *